US005149496A

United States Patent [19]

Das et al.

[11] Patent Number: 5,149,496

[45] Date of Patent: Sep. 22, 1992

[54] METHOD OF MAKING HIGH STRENGTH, HIGH STIFFNESS, MAGNESIUM BASE METAL ALLOY COMPOSITES

[75] Inventors: Santosh K. Das, Randolph; Chin-Fong Chang, Morris Plains; Derek Raybould, Denville, all of N.J.

[73] Assignee: Allied-Signal Inc., Morristownship, Morristown County, N.J.

[21] Appl. No.: 826,542

[22] Filed: Jan. 27, 1992

Related U.S. Application Data

[62] Division of Ser. No. 650,134, Feb. 4, 1991.

[51] Int. Cl.[5] ..... B22F 1/00

[52] U.S. Cl. ..... 419/17; 419/32; 419/33; 419/41; 419/48; 419/60

[58] Field of Search ..... 419/17, 32, 33, 41, 419/48, 60

[56] References Cited

U.S. PATENT DOCUMENTS 4,941,918 7/1990 Horikoshi et al. ..... 419/17

*Primary Examiner*—Stephen J. Lechert, Jr.

*Attorney, Agent, or Firm*—Ernest D. Buff; Gerhard H. Fuchs

[57] ABSTRACT

A magnesium based metal matrix composite is made from rapidly solidified magnesium alloy powder and SiC particulate using liquid suspension coprocessing or mechanical alloying. The composite is suitable for consolidation into bulk shapes having, in combination, high strength, high stiffness, low density, low coefficient of thermal expansion, and high hardness. The composite is suited for uses in such applications as space and missile guidance and navigation and control system precision components where low density, very high specific stiffness and long term dimensional and environmental stability are principal performance criteria.

7 Claims, 8 Drawing Sheets

METHOD OF MAKING HIGH STRENGTH, HIGH STIFFNESS, MAGNESIUM BASE METAL ALLOY COMPOSITES

This application is a division, of application Ser. No. 07/650,134, filed Feb. 4, 1991

BACKGROUND OF THE INVENTION

1. Field of the Invention

This invention relates to high strength, high stiffness magnesium base metal alloy composites, and more particularly to products made from a mixture containing rapidly solidified magnesium alloy powders and SiC particulate using liquid suspension coprocessing or mechanical alloying followed by consolidation to bulk articles.

2. Description of the Prior Art

Magnesium alloys are considered attractive candidates for structural use in aerospace and automotive industries because of their light weight, high strength to weight ratio, and high specific stiffness at both room and elevated temperatures. However, their low mechanical strength, low stiffness, and poor corrosion resistance have prevented wide scale use of magnesium alloys. Furthermore, the alloys are comparatively soft and are subject to galling and seizing when engaged in rubbing friction under load.

The application of rapid solidification Processing (RSP) in magnesium alloys results in the refinement of grain size and intermetallic particle size, extended solid solubility, and improved chemical homogeneity. By selecting the thermally stable intermetallic compound ($Mg_2Si$) to pin the grain boundary during consolidation, a significant improvement in the mechanical strength [0.2% yield strength (TYS) up to 393 MPa (57 ksi), ultimate tensile strength (UTS) up to 448 MPa (65 ksi), elongation (El.) up to 9%] can be achieved in RSP Mg-Al-Zn-Si alloys, [S. K. Das et al., U.S. Pat. No. 4,675,157, High Strength Rapidly Solidified Magnesium Base Metal Alloys, June 1987]. Addition of rare earth elements (Y, Nd, Pr, Ce) to Mg-Al-Zn alloys further improves corrosion resistance (11 mdd when immersed in 3% NaCl aqueous solution for $3.4\times10^5$ sec at 27° C.) and mechanical properties [TYS up to 435 MPa (63 ksi), UTS up to 476 MPa (69 ksi), El up to 14%] of magnesium alloys, [S. K. Das & C. F. Chang, U.S. Pat. No. 4,765,954, Rapidly Solidified High Strength, Corrosion Resistant Magnesium Base Metal Alloys, August 1988].

Metal matrix composites (MMC's) have been the subject of intense research and development within the past ten years. Metal matrix composites consist of a metal base that is reinforced with one or more constituents, such as continuous graphite, alumina, silicon carbide, or boron fibers and discontinuous graphite or ceramic materials in particulate or whisker form. By combining the high strength, stiffness, and wear resistance of ceramics with the toughness and formability of metals, MMC's provide mechanical properties markedly superior to those of unreinforced alloys of comparable density. The incorporation of hard phases as reinforcements to a magnesium matrix can result in enhanced specific strength and specific modulus as compared to the monolithic materials.

There are currently two types of magnesium composites: continuous fiber reinforced and particulate/-whisker reinforced magnesium. In the case of continuous fiber reinforced composites, the fiber is the dominating constituent, and the magnesium matrix serves as a vehicle for transmitting the load of reinforcing fiber. Properties of continuous fiber reinforced composites rely on the filament properties and the capability of the fiber/matrix interface to transfer load. Composites that incorporate discontinuous reinforcement are matrix dominated, forming a pseudo dispersion hardened structure. The primary strengthening mechanism is the retardation of dislocation movements by the fine dispersion of reinforcement.

Three distinct methods have been used to prepare magnesium metal-matrix composites: a liquid metal (melt) infiltration method, a semi-solid metal forming method, and a powder metallurgy (P/M) method.

Liquid metal methods for the fabrication of metal matrix composites have the advantages of relative simplicity, flexibility, economy, and ease of production of complex shapes, [A. Mortensen et al., Solidification Processing of Metal-Matrix Composites, Journal of Metals, 40, Feb. 1988, pp. 12–19], [P. Rohatgi, Cast Metal-Matrix Composites, Metals Handbook, Ninth Edition, 15, 1988, pp. 840–854]. A basic requirement of liquid metal processing of composites is the intimate contact and bonding between the reinforcement and the molten alloy. This requirement may be met either by mixing the reinforcement, generally a form of particulate, into the partially or fully molten alloy, or by the use of pressure to infiltrate reinforcement preforms with liquid metal. For those casting processes requiring ceramic preforms, the wettability of the ceramic reinforcement by the metal matrix alloy particularly affects the pressure requirements for infiltration, the quality of the interface bond and the nature of the defects in the resultant casting. For casting processes which depend upon introducing and dispersing a reinforcement into a melt or vigorously agitated, partially solidified slurries, a number of techniques have been developed. Examples include addition or injection of particles to a vigorously agitated alloy; dispersion of pellets or briquettes in a mildly agitated melt; powder addition in an ultrasonically agitated melt; addition of powders to an electromagnetically stirred melt; and centrifugal dispersion of particles in a melt, [P. Rohatgi, Foundary Processing of Metal Matrix Composites, Modern Casting, April 1988, pp. 47–50].

Semi-solid metal (SSM) forming incorporates both casting and forging [M. P. Kenney, et al., Semisolid Metal Casting and Forging", Metals Handbook, Ninth Edition, 15, 1988, pp. 327–338]. The process involves mixing of a particulate reinforcement into a molten magnesium alloy, followed by direct chill (DC) casting of the composite under conditions of magnetohydrodynamic (MHD) stirring. These steps yield a microstructure, which when reheated to the semi-solid state, responds to forming into near net shape components.

Powder metallurgy MMC's, which require considerable time and care to produce, typically have tensile and fatigue properties superior to those of melt-infiltrated composites due to the advantages of lower temperature processing which reduces the chance of interface reaction, and blending of powder/reinforcement constituents which are incompatible in liquid state handling.

The P/M process starts with mixing and blending prealloyed metallic powder and reinforcement particulates/whiskers, followed by heating and degassing, and finally consolidation into intermediate or final product forms. During the critical states of production, measured quantities of reinforcement constituents and fine mesh metal alloy powders are thoroughly mixed and blended to establish a high degree of particle intermingling. Lubricants and selected additives are usually employed in this kind of metal and ceramic multicomponent powder system to help overcome some of the problems inherent to the mechanics of mixing, [P. E. Hood and J. O. Pickens, Silicon Carbide Whisker Composites, U.S. Pat. No. 4,463,058, July 1984]. The adverse effects of interparticle friction, electrostatic attraction, and density differences must be reduced to facilitate flow during mixing and blending. Mechanically interlocked agglomerates of whiskers also must be separated to establish a statistically random dispersion. This can normally be achieved with high-velocity high-shear blending equipment. The production of dense, porosity-free MMC's by a P/M process critically depends on proper treatment of the composite powder blends to remove volatile contaminants effectively. Residual organics, such as lubricants and other mixing and blending additives, must be completely extracted before consolidation. Water vapor and gases adsorbed to the particle surfaces must also be removed.

Each of the previously P/M processes uses conventional gas atomized magnesium alloy powder in the matrix. A number of other variations exist for powder processing of composites. However, the blending, pressing and sintering steps are virtually all regarded as proprietary technology, and thus very few details are available in the published literature.

There remains a need in the art for high strength high stiffness magnesium base metal alloy composites having the form of bulk articles consolidated from a powder mixture containing rapidly solidified magnesium alloy powders and SiC particulate.

SUMMARY OF THE INVENTION

The present invention provides a method of making a high strength, high stiffness magnesium base metal matrix alloy composite, wherein a mixture containing rapidly solidified magnesium alloy powder and SiC particulate is subjected to liquid suspension coprocessing or mechanical alloying followed by consolidation into a article. Generally, the matrix alloy has a composition consisting essentially of the formula $Mg_{bal}Al_aZn_bXc$, wherein X is at least one element selected from the group consisting of manganese, cerium, neodymium, praseodymium, and yttrium, "a" ranges from about 0 to 15 atom percent, "b" ranges from about 0 to 4 atom percent, "c" from about 0.2 to 3 atom percent, the balance being magnesium and incidental impurities, as disclosed by Das et al. U.S. Pat. No. 4,765,954.

The magnesium matrix alloys of which the composite of the present invention is comprised are subjected to rapid solidification processing by a melt spin casting method wherein the liquid alloy is cooled at a rate of $10^6$ to $10^7$° C./sec while being formed into a solid ribbon, as disclosed by Das et al. U.S. Pat. No. 4,675,157. The alloying elements manganese, cerium, neodymium, praseodymium, and yttrium, upon rapid solidification processing, form a fine uniform dispersion of intermetallic phases such as $Mg_3Ce$, $Al_2(Nd,Zn)$, $Al_2Y$, and $Mg_3Pr$, depending on the alloy composition. These finely dispersed intermetallic phases increase the strength of the matrix alloy and help to maintain a fine grain size by pinning the grain boundaries during consolidation of the powder at elevated temperature. The addition of the alloying elements: aluminum and zinc, contributes to strength via matrix solid solution strengthening and by formation of certain age hardening precipitates such as $Mg_{17}Al_{12}$, and MgZn.

In accordance with the present invention, rapidly solidified magnesium base metal powder is mixed and blended with silicon carbide reinforcing material using liquid suspension coprocessing or mechanical alloying to achieve substantially uniform distribution of particulates in the mixture.

Following the mixing and blending step the mixture is consolidated into the composite. The mixture can be hot pressed by heating in a vacuum to a pressing temperature ranging from 250° C. to 500° C., which provides sufficient bonding strength between matrix and reinforcing particulates but minimizes coarsening of the dispersed, intermetallic phases in the matrix. The mixture can also be consolidated into bulk shapes using conventional methods such as extrusion, and forging. The billets are then hot extruded to round or rectangular bars having an extrusion ratio ranging from 8:1 to 22:1 using flat or conical die. The extrusion temperature normally ranges from 250° C. to 500° C. The extrusion of MMC's shows very attractive properties. For example: $Mg_{92}Al_5Zn_2Nd_1$ + 10 v/o SiC has a density of 2.11 kg/m$^3$ (0.076 lb/in$^3$), Rockwell B hardness of 90, coefficient of thermal expansion of $19\times10^{-6}$/° C. ($10.9\times10^{-6}$° F.), ultimate compressive strength of 570 MPa (82.6 ksi), compressive strain of 1.1%, and elastic modulus of 72 GPa (10.4 Msi).

The billets can also be forged at temperatures ranging from 250° C. to 500° C. using a multiple closed die forging process with 20% reduction in height for each operation. The forging of MMC's also shows very attractive properties. For example: $Mg_{92}Al_5Zn_2Nd_1$ + 30 v/o SiC has a density of 2.36 kg/m$^3$ (0.085 lb/in$^3$), Rockwell B hardness of 102, coefficient of thermal expansion of $12.8\times10^{-6}$/° C. ($7.1\times10^{-6}$/° F.), ultimate compressive strength of 690 MPa (100 ksi), compressive strain of 0.4%, and elastic modulus of 85 GPa (12.3 Msi).

The magnesium base metal matrix composite can be used in applications involving space and missile guidance, navigation, and control system precision components, where low density, very high specific stiffness and long term dimensional and environmental stability are major performance criteria. Representative of such applications are an advanced composite optical system gimbal, guidance and control components, mirrors and precision components, gyro parts, instrumental covers, gyroscopes, accelerometers, and startracker mounting platforms.

BRIEF DESCRIPTION OF THE DRAWINGS

This invention will be more fully understood and further advantages will become apparent when reference is made to the following detailed description and the accompanying drawings, in which.

DESCRIPTION OF THE PREFERRED EMBODIMENTS

Figure 1:
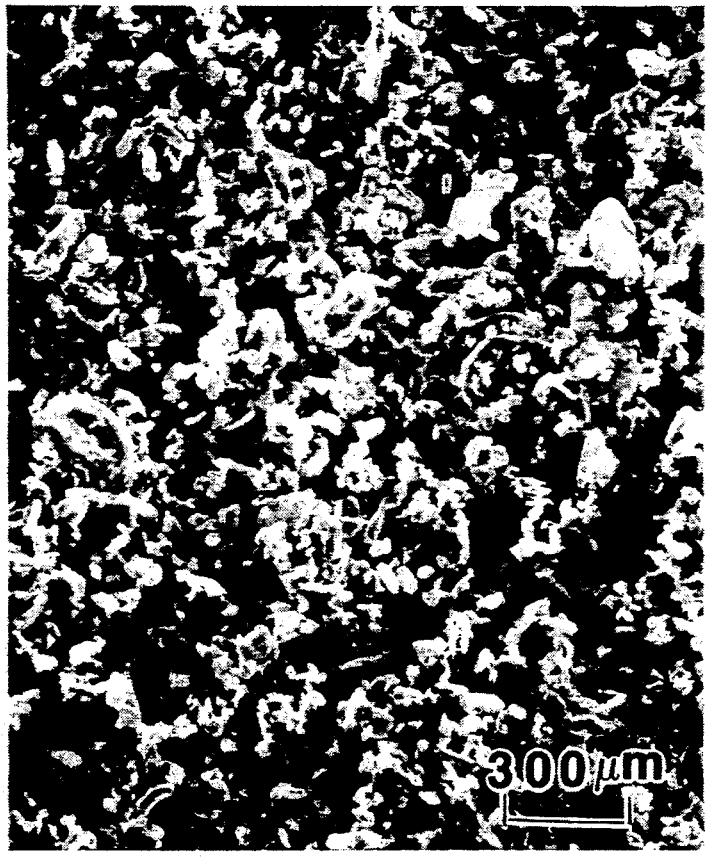
FIG. 1 is a scanning electron micrograph of typical RS Mg alloy powders (−60 mesh) comminuted from as-cast ribbons.

The present invention provides a high strength, high stiffness magnesium base metal matrix alloy composites, consolidated from a mixture containing rapidly solidified magnesium alloy powder and SiC particulate, the mixture having been subjected to liquid suspension coprocessing or mechanical alloying. The magnesium matrix alloy of which the composite of the present invention is comprised consists essentially of the formula $Mg_{bal}Al_aZn_bX_c$, wherein X is at least one element selected from the group consisting of manganese, cerium, neodymium, praseodymium, and yttrium, "a" ranges from about 0 to 15 atom percent, "b" ranges from about 0 to 4 atom percent, "c" ranges from about 0.2 to 3 atom percent, the balance being magnesium and incidental impurities.

The matrix alloy is melted in a protective environment; and then quenched in a protective environment at a rate of at least about $10^5$° C./sec by directing the melt into contact with a rapidly moving chill surface to form thereby a rapidly solidified ribbon. Such alloy ribbons have high strength and high hardness (i.e. microVickers hardness of at least about 125 kg/mm$^2$).

The matrix alloys of the consolidated article from which the composite of the invention is produced have a very fine microstructure which is not resolved by optical microscopy. Transmission electron microscopy reveals a substantially uniform cellular network of solid solution phase ranging from 0.2–1.0 μm in size, together with precipitates of very fine, binary intermetallic phases which are less than 0.1 μm and composed of magnesium and other elements added thereto.

The mechanical properties [e.g. 0.2% yield strength (TYS) and ultimate tensile strength (TUS)]of the matrix alloys are substantially improved when the precipitates of the intermetallic phases have an average size of less than 0.1 μm, and even more preferably an average size ranging from about 0.03 to 0.07 μm. The presence of intermetallic phase precipitates having an average size less than 0.1 μm Pins the grain boundaries during consolidation of the powder at elevated temperature, with the result that a fine grain size is substantially maintained during high temperature consolidation.

The as-cast ribbon is typically 25 to 50 μm thick. The rapidly solidified materials of the above described compositions are sufficiently brittle to permit them to be mechanically comminuted by conventional apparatus, such as a ball mill, knife mill, hammer mill, pulverizer, fluid energy mill, or the like. Depending on the degree of pulverization to which the ribbons are subjected, different particle sizes are obtained. Generally stated, after casting, the ribbon is typically comminuted into −35 to −60 mesh US sieve size (500–250 μm) powder. Usually the powder comprises platelets having an average thickness of less than 100 μm. These platelets are characterized by irregular shapes resulting from fracture of the ribbon during comminution.

The rapidly solidified magnesium base metal alloy powder is mixed and blended with silicon carbide reinforcing material using liquid suspension coprocessing to achieve substantially uniform distribution of SiC in the mixture. Generally stated, silicon carbide particulate with size ranging from < 5 to 75 μm is washed in 0.01N $KNO_3$ in distilled water to remove the impurities and then dried at temperatures ranging from 400° C. to 550° C. for 8 to 24 hours. Rapidly solidified magnesium base metal alloy powder and SiC particulate are then suspended and coprocessed in distilled water at pH ranging from 8.5 to 11.5 by ultrasonification, (pH can be adjusted by the addition of dilute alkaline solution such as sodium hydroxide). In the presence of sufficiently alkaline solutions, magnesium alloy powders can cover itself with a layer of magnesium oxide or hydroxide, which protects the matrix alloy from corrosion. The mixture is then filtered, washed with distilled water and thereafter dried at temperature ranging from 50° C. to 100° C.

The magnesium base metal alloy composite is also prepared by mechanical alloying of rapidly solidified magnesium base metal alloy powder and silicon carbide reinforcing material, using a commercial ball milling machine to achieve substantially uniform distribution of SiC in the composite. There are potentially serious safety hazards in ball-milling magnesium powders. It is known that magnesium oxidizes rapidly on the surface. The high surface-to-volume ratio of small magnesium particles, combined with the high heat of oxidation, raises the powder particle temperature above the ambient temperature. The apparent ignition temperature is lower with smaller sized particles. When particles are approximately 0.1 μm in size, apparent ignition temperature is room temperature, and fire can occur spontaneously. Explosion is the greatest hazard associated with magnesium powder. If magnesium powder is fine enough, so that an air suspension can be obtained, any source of ignition will result in a violent explosion. This invention provides the safety practice of mechanical alloying magnesium base metal alloy composite. Generally stated, rapidly solidified magnesium base metal alloy powder and SiC particulates (<5 μm) were loaded with metallic or ceramic balls with diameter ranging from ¼" to 1" in metallic or ceramic vial, for example: tool steel or tungsten carbide, in vacuum or protective atmosphere, for example: argon. The weight ratio of ball to powder of the mixture ranged from 1:1 to 6:1. The mixture was then ball-milled for 0.5 to 48 hours dependent on the charge weight. After ball milling, the mixture was unloaded in the protective atmosphere.

The mixture is readily consolidated into fully dense bulk parts by known techniques such as hot isostatic pressing, hot extrusion, hot forging, etc. Typically, the mixture can be either canned or vacuum hot pressed to cylindrical billets with diameter ranging from 50 mm to 110 mm and length ranging from 50 mm to 140 mm at temperatures ranging from 250° C. to 500° C. for 0.5 to 24 hours dependent on the size of billet or can.

The billets are then hot extruded to round or rectangular bars having an extrusion ratio ranging from 8:1 to 22:1 using flat or conical die. Generally, each of the extruded bars has a thickness of at least 6 mm measured in the shortest dimension. The extrusion temperature normally ranges from 250° C. to 500° C. Prior to extrusion, the billet was soaked at temperatures ranging from 250° C. to 500° C. for 0.5 to 4 hours. The extrusion of MMC's shows very attractive properties. For example: $Mg_{92}Al_5Zn_2Nd_1$ + 10 v/o SiC has a density of 2.11 kg/m$^3$ (0.076 lb/in$^3$), Rockwell B hardness of 90, coefficient of thermal expansion of $19\times10^{-6}$/° C. ($10.9\times10^{-6}$/° F.), ultimate compressive strength of 570

MPa (82.6 ksi), compressive strain of 1.1%, and elastic modulus of 72 GPa (10.4 Msi).

The billets can also be forged at temperatures ranging from 250° C. to 500° C. at a rate ranging from 0.00021 m/sec to 0.00001 m/sec using a multiple closed die forging process with 20% reduction in height for each operation. During the final step forging was carried out in an open-die at a reduction of about 50%. Prior to each forging operation, the billet was soaked at temperatures ranging from 250° C. to 500° C. for 0.5 to 4 hours. The forgings of MMC's also show very attractive properties. For example: $Mg_{92}Al_5Zn_2Nd_1$ + 30 v/o Sic has a density of 2.36 kg/m$^3$ (0.085 lb/in$^3$), Rockwell B hardness of 102, coefficient of thermal expansion of $12.8\times10^{-6}$/° C. ($7.1-10^{-6}$/° F.), ultimate compressive strength of 690 MPa (100 ksi), compressive strain of 0.4%, and elastic modulus of 85 GPa (12.3 Msi).

The magnesium base metal matrix composite can be used in applications involving space and missile guidance, navigation, and control system precision components, where low density, very high specific stiffness and long term dimensional and environmental stability are the major performance criteria. Representative of such applications are: an advanced composite optical system gimbal, guidance and control components, mirrors and precision components, gyro parts, instrumental covers, gyroscopes, accelerometers, and startracker mounting platforms.

The following examples are presented in order to provide a more complete understanding of the invention. The specific techniques, conditions, materials and reported data set forth to illustrate the invention are exemplary and should not be construed as limiting the scope of the invention.

EXAMPLE 1

Ribbon samples were cast in accordance with the procedure described above by using an over pressure of argon or helium to force molten magnesium alloy through the nozzle onto a water cooled copper alloy wheel rotated to produce surface speeds of between about 900 m/min and 1500 m/min. Ribbons were 0.5–2.5 cm wide and varied from about 25 to 50 μm thick.

The nominal compositions of the matrix alloy based on the charge weight added to the melt are summarized in Table 1 together with their as-cast hardness values. The hardness values are measured on the ribbon surface which is facing the chilled substrate; this surface being usually smoother than the other surface. The microhardness of these Mg-Al-Zn-X matrix alloys ranges from 140 to 200 kg/mm$^2$. The as-cast hardness increases as the rare earth content increases. The hardening effect of the various rare earth elements on Mg-Al-Zn-X alloys is comparable. For comparison, also listed in Table 1 is the hardness of a commercial corrosion resistant high purity magnesium casting alloy AZ91D. It can be seen that the hardness of matrix alloy used in the present invention is higher than commercial casting alloy AZ91D.

TABLE 1

Microhardness (kg/mm$^2$) values of R. S. Mg—Al—Zn-X as-cast ribbons

| Sample No. | Alloy Nominal (at %) | Hardness |
|---|---|---|
| 1 | $Mg_{92.5}Al_5Zn_2Ce_{0.5}$ | 151 |
| 2 | $Mg_{92}Al_5Zn_2Ce_1$ | 186 |
| 3 | $Mg_{92.5}Al_5Zn_2Pr_{0.5}$ | 150 |
| 4 | $Mg_{91}Al_5Zn_2Y_2$ | 201 |
| 5 | $Mg_{88}Al_{11}Mn_1$ | 162 |
| 6 | $Mg_{88.5}Al_{11}Nd_{0.5}$ | 140 |
| 7 | $Mg_{92}Al_5Zn_2Nd_1$ | 183 |
| | Commercial casting alloy AZ91D | |
| 8 | $Mg_{91.7}Al_8Zn_{0.2}Mn_{0.1}$ | 116 |

EXAMPLE 2

Rapidly solidified magnesium alloy ribbons were subjected first to knife milling and then to hammer milling to produce −35 to −60 mesh U. S. sieve size (500–250 μm) powders. In general, the final product consists of irregularly shaped flat platelets with a thickness equal to the original ribbon thickness, FIG. 1.

Figure 2A:
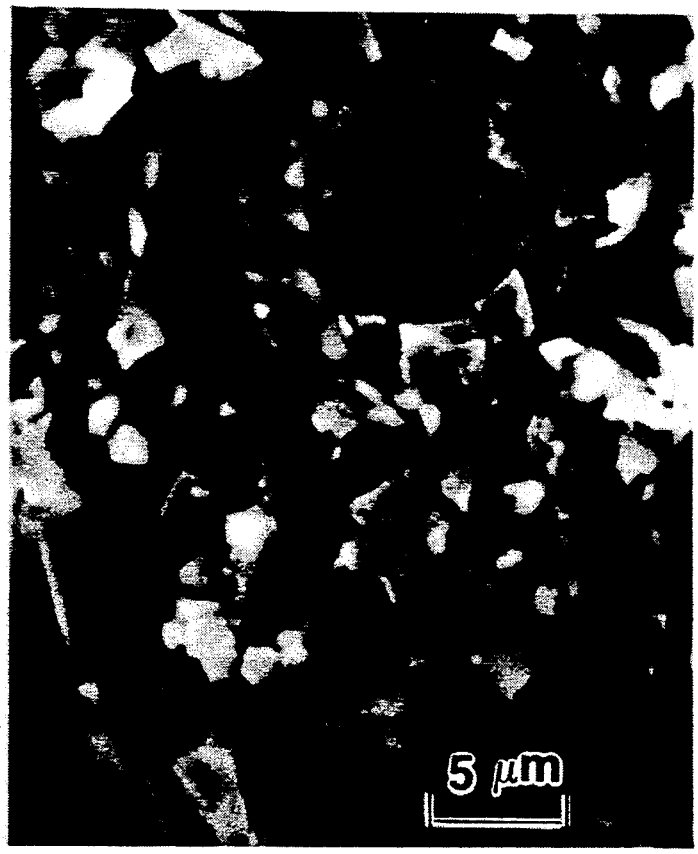
FIG. 2 is a scanning electron micrograph of washed (2*a*) fine (< 5 μm), (2*b*) medium (< 45 μm), (2*c*) coarse (< 75 μm) SiC particulates.
Figure 2B:
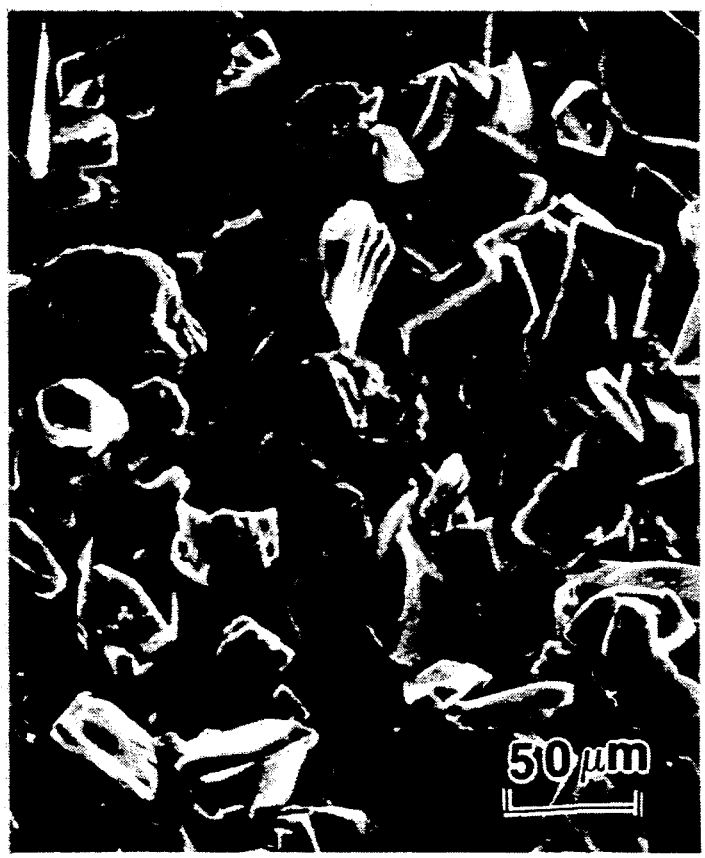
Figure 2C:
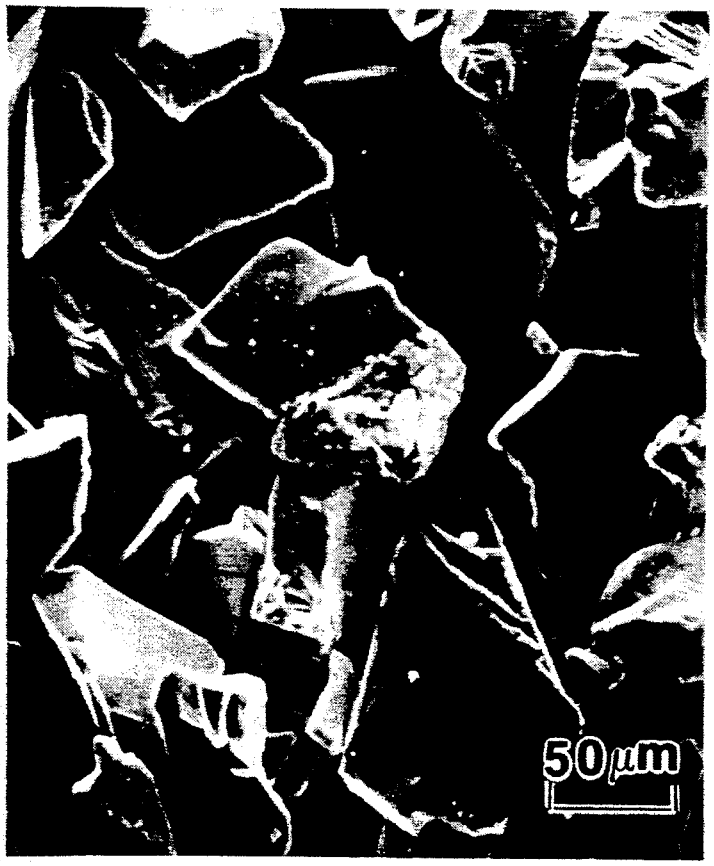

Silicon carbide particulates with size ranging from 5 to 75 μm were washed in 0.01N $KNO_3$ in distilled water to remove the impurities and then dried at temperatures ranging from 400° C. to 550° C. for 8 to 24 hours. FIG. 2 shows a scanning electron micrograph of typical fine and coarse washed SiC particulate.

Figure 3:
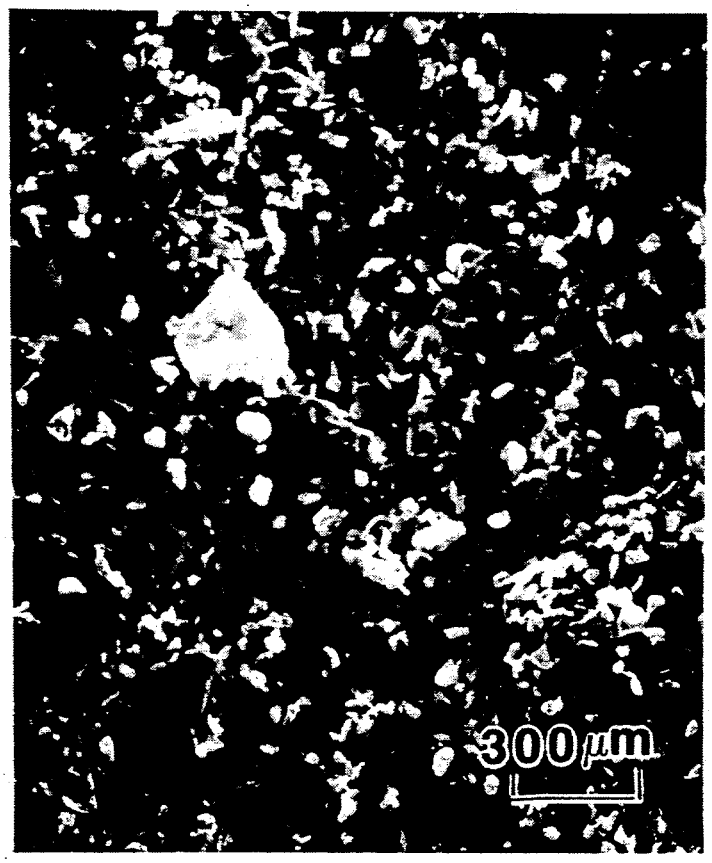
FIG. 3 is a scanning electron micrograph of a mixture of RS Mg alloy powders and SiC particulates using liquid suspension coprocessing.

Rapidly solidified magnesium base metal alloy powder and SiC particulate with volume fraction ranging from 5 to 30% were then suspended and coprocessed in distilled water at the pH ranging from 8.5 to 11.5 by ultrasonification, (pH was adjusted by the addition of dilute alkaline solution such as sodium hydroxide). In the presence of sufficiently alkaline solutions, magnesium alloy powders were covered with a layer of magnesium oxide or hydroxide, which protected the matrix alloy from corrosion. The mixture was then filtered, washed with distilled water and then dried at temperature ranging from 50° C. to 100° C. FIG. 3 shows a scanning electron micrograph of the mixture after suspension processing indicating a uniform distribution of SiC particulates on the surface of magnesium powders.

Figure 4A:
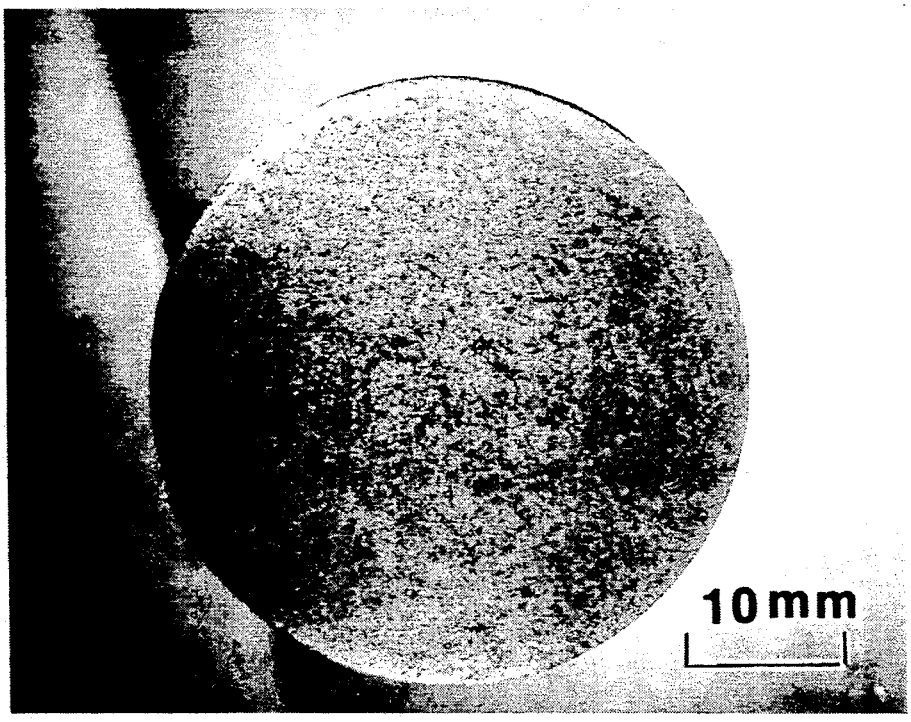
FIGS. 4(*a*) and 4(*b*) are optical macrographs of a composite after vacuum hot pressing, showing a uniform distribution of SiC therein.
Figure 4B:
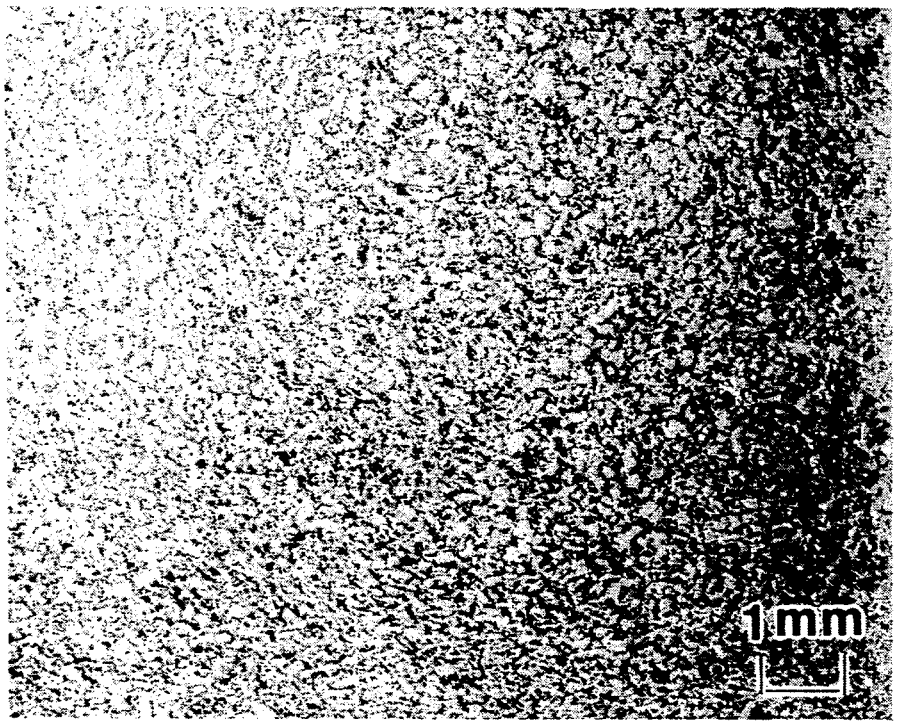

The mixture of rapidly solidified magnesium alloy powder and SiC particulate was vacuum outgassed and hot pressed at 250–500° C. for 0.5 to 2 hours. FIGS. 4(*a*) and 4(*b*) are optical macrographs of a composite after vacuum hot pressing, FIG. 4(*b*) showing a uniform distribution of SiC in the composite. Table 2 summarizes the constituents, and density of vacuum hot pressed billets [38 mm (1.5") in diameter].

TABLE 2

Properties of vacuum hot pressed magnesium alloy composite using liquid suspension coprocessing

| Sample No. | Matrix Alloy Composition Nominal (at %) | SiC (Vol. %) | Density (kg/m$^3$) |
|---|---|---|---|
| 9 | $Mg_{91}Al_5Zn_2Y_2$ | 20 | 1.94 |
| 10 | $Mg_{91}Al_5Zn_2Y_2$ | 30 | 2.10 |

The vacuum hot pressed compacts were extruded at temperatures of about 250–500° C. at extrusion ratios ranging from 8:1 to 22:1. The compacts were soaked at the extrusion temperature for about 0.5–4 hours. The density of extruded composite measured at room temperature is summarized in Table 3.

TABLE 3

| Properties of extruded magnesium alloy composite using liquid suspension coprocessing | | | |
|---|---|---|---|
| Sample No. | Matrix Alloy Composition Nominal (at %) | SiC (Vol. %) | Density ($kg/m^3$) |
| 11 | $Mg_{92}Al_5Zn_2Nd_1$ | 5 | 1.95 |
| 12 | $Mg_{92}Al_5Zn_2Nd_1$ | 10 | 1.99 |
| 13 | $Mg_{92}Al_5Zn_2Nd_1$ | 15 | 1.96 |
| 14 | $Mg_{92}Al_5Zn_2Nd_1$ | 20 | 1.98 |
| 15 | $Mg_{92}Al_5Zn_2Nd_1$ | 30 | 1.97 |

Tensile samples were machined from the extruded bulk compacted bars using diamond composition tool or carbide inserts and tensile properties of the extruded composite were evaluated according to ASTM standard D 3552-77 (reapproved 1982) [Standard Test Method for Tensile Properties of Fiber Reinforced Metal Matrix Composites].

Tensile properties were measured in uniaxial tension at a strain rate of about $10^{-4}$/sec at room temperature. The tensile properties measured at room temperature are summarized in Table 4. For composite with volume percentage of SiC equal to or less than 10, the tensile yield strength is higher than matrix alloy but with lower ductility. For composite with volume percentage of SiC greater than 10, due to the brittle nature of the composite and cracking induced by diamond grinding, the tensile testing only reflects the breaking stress of the composite.

TABLE 4

| Properties of extruded magnesium alloy composite using liquid suspension coprocessing | | | | | |
|---|---|---|---|---|---|
| Sample No. | Matrix Alloy Composition Nominal (at %) | SiC (Vol. %) | 0.2% TYS MPa | TUS MPa | El (%) |
| 16 | $Mg_{92}Al_5Zn_2Nd_1$ | 5 | 474 | 506 | 1.3 |
| 17 | $Mg_{92}Al_5Zn_2Nd_1$ | 10 | 442 | 454 | 0.6 |
| 18 | $Mg_{92}Al_5Zn_2Nd_1$ | 15 | 362 | 363 | 0.2 |
| 19 | $Mg_{92}Al_5Zn_2Nd_1$ | 20 | 338 | 339 | 0.1 |
| 20 | $Mg_{92}Al_5Zn_2Nd_1$ | 30 | 321 | 321 | 0.1 |
| 21 | $Mg_{91}Al_5Zn_2Y_2$ | 5 | 434 | 434 | 0.1 |
| 22 | $Mg_{91}Al_5Zn_2Y_2$ | 10 | 390 | 390 | 0.1 |
| 23 | $Mg_{91}Al_5Zn_2Y_2$ | 15 | 285 | 285 | 0.1 |
| | Sample Outside of Invention | | | | |
| 24 | $Mg_{92}Al_5Zn_2Nd_1$ | 0 | 435 | 476 | 14.0 |

EXAMPLE 3

The mixture of rapidly solidified magnesium alloy powder and SiC particulate was processed by mechanical alloying using ball milling technique. Generally stated, rapidly solidified magnesium base metal alloy powder and SiC particulate (< 5 μm) were loaded with ¼" diameter tool steel balls in tungsten carbide vial, in vacuum or protective atmosphere, for example: argon. The weight ratio of balls to powders of mixture ranges from 1:1 to 6:1. The mixture was then ball - milled for 0.5–6 hours. After ball milling, the mixture was unloaded in the protective atmosphere.

Figure 5:
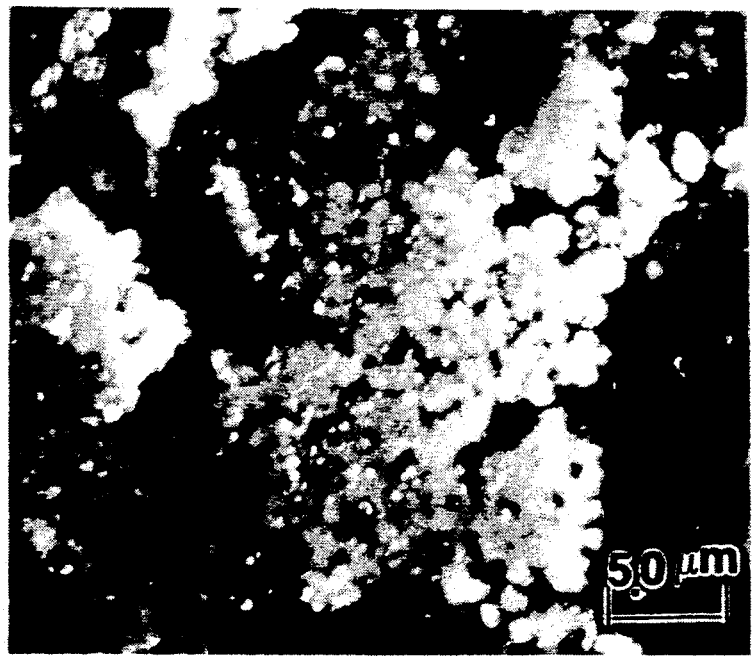
FIG. 5 is a scanning electron micrograph of a mixture of RS Mg alloy powders and SiC particulates after ball milling for 6 hours with balls/powders weight ratio of 3, showing a uniform distribution of SiC particulates in the composite.

FIG. 5 shows a scanning electron micrograph of the powder mixture after mechanical alloying illustrating uniform distribution of SiC particulate therein. The mixture was then vacuum outgassed and hot pressed at 300°–500° C. for 0.5 to 2 hours. Table 5 summarizes the constituents, density, and hardness and coefficient of thermal expansion (measured from 50° C. to 450° C.) of vacuum hot pressed billets (1.5" diameter). The composites show high density ranging from 2.11 to 2.36 $kg/m^3$, high hardness ranging from 90 to about 106 RB, and low coefficient of thermal expansion ranging from 19 to 14.6 ppm/° C. FIGS. 4(*a*) and 4(*b*) are optical macrographs of the composite after vacuum hot pressing, FIG. 4(*b*) showing a uniform distribution of SiC therein.

TABLE 5

| Properties of vacuum hot pressed magnesium alloy composite billet processed by mechanical alloying | | | | | |
|---|---|---|---|---|---|
| Sample No. | Matrix Alloy Composition Nominal (at %) | SiC (Vol. %) | Density ($kg/m^3$) | Hardness (RB) | CTE (20–450° C.) $\times 10^{-6}$/°C. |
| 25 | $Mg_{92}Al_5Zn_2Nd_1$ | 10 | 2.11 | 90 | 19.0 |
| 26 | $Mg_{92}Al_5Zn_2Nd_1$ | 20 | 2.21 | 97 | 17.6 |
| 27 | $Mg_{92}Al_5Zn_2Nd_1$ | 30 | 2.36 | 102 | 14.6 |
| | Sample Outside of Invention | | | | |
| 28 | $Mg_{92}Al_5Zn_2Nd_1$ | 0 | 1.93 | 76 | 28.2 |

EXAMPLE 4

The vacuum hot pressed compacts were extruded at temperatures of about 250°–500° C. at extrusion ratios ranging from 8:1 to 22:1. The compacts were soaked at the extrusion temperature for about 0.5–4 hours prior to extrusion. Table 6 summarizes the constituents, density, and hardness of the extruded composites, which are about the same as those of the vacuum hot pressed billets, indicating no loss of properties during hot extrusion. The composites of the present invention show high hardness ranging from 93 to 104 RB. The density of the extruded composites measured by conventional Archimedes techniques is also listed in Table 6. The extruded composites exhibit densities ranging from 2.11 to 2.36 $kg/m^3$.

TABLE 6

| Properties of extruded magnesium alloy composites processed by mechanical alloying | | | | |
|---|---|---|---|---|
| Sample No. | Matrix Alloy Composition Nominal (at %) | SiC (Vol. %) | Density ($kg/m^3$) | Hardness (RB) |
| 29 | $Mg_{92}Al_5Zn_2Nd_1$ | 10 | 2.11 | 93 |
| 30 | $Mg_{92}Al_5Zn_2Nd_1$ | 20 | 2.23 | 98 |
| 31 | $Mg_{92}Al_5Zn_2Nd_1$ | 30 | 2.36 | 104 |

Tensile samples were machined from the extruded bulk compacted bars using diamond composition tool or carbide inserts and tensile properties of the extruded composites were evaluated according to ASTM standard D 3552-77 (reapproved 1982) [Standard Test Method for Tensile Properties of Fiber-Reinforced Metal Matrix Composites].

Tensile properties were measured in uniaxial tension at a strain rate of about $10^{-4}$/sec at room temperature. The tensile properties at room temperature are summarized in Table 7. Due to the brittle nature of the composites and cracking induced by diamond grinding, the tensile testing only reflects the breaking stresses of the composites.

TABLE 7

| Sample No. | Properties of extruded magnesium alloy composite processed by mechanical alloying: Matrix Alloy Composition Nominal (at %) | SiC (Vol. %) | 0.2% TYS MPa | TUS MPa | El (%) |
|---|---|---|---|---|---|
| 32 | $Mg_{92}Al_5Zn_2Nd_1$ | 10 | 285 | 285 | 0.1 |
| 33 | $Mg_{92}Al_5Zn_2Nd_1$ | 20 | 281 | 281 | 0.1 |
| 34 | $Mg_{92}Al_5Zn_2Nd_1$ | 30 | 434 | 434 | 0.1 |

Extrusions were machined by electro discharge machining (EDM) to specimens of 0.16" in diameter and 1" in length, with longitudinal direction along the extrusion direction, for compression testing. Compressive properties of the extruded composites were evaluated according to ASTM standard E9-81 [Standard Methods for Compression Testing of Metallic Materials at Room Temperature]. Compressive properties were measured in uniaxial compression along the longitudinal direction at a strain rate of about $8\times10^{-4}$/sec at room temperature. The compressive properties measured at room temperature are summarized in Table 8. The extrusion of MMC's shows very attractive properties. For example: $Mg_{92}Al_5Zn_2Nd_1$ + 10 v/o SiC has a density of 2.11 kg/m$^3$ (0.076 lb/in$^3$), Rockwell B hardness of 90, coefficient of thermal expansion of $19\times10^{-6}$/° C. ($10.9\times10^{-6}$/° F.), ultimate compressive strength of 570 MPa (82.6 ksi), compressive strain of 1.1%, and elastic modulus of 72 GPa (10.4 Msi).

TABLE 8

| Sample No. | Compressive properties of extruded magnesium alloy composite processed by mechanical alloying: Matrix Alloy Compostion Nominal (at %) | SiC (Vol. %) | 0.2% CYS MPa | CUS MPa | El (%) | E GPa |
|---|---|---|---|---|---|---|
| 35 | $Mg_{92}Al_5Zn_2Nd_1$ | 10 | 552 | 570 | 1.1 | 72 |
| | Sample Outside of Invention | | | | | |
| 36 | $Mg_{92}Al_5Zn_2Nd_1$ | 0 | 418 | 441 | 5.9 | 47 |

EXAMPLE 5

The vacuum hot pressed compacts were forged to pancakes at temperatures of about 350–500° C. by five-step closed die forging process using flat dies with 20% reduction in height for each operation. The compacts were soaked at the forging temperature for about 2–4 hours prior to forging. At the fifth step, samples were open-die forged at a reduction of about 50%. Table 9 summarizes the constituents, density, and hardness of forged composite, which are about the same as those of vacuum hot pressed billet, indicating no loss of properties during hot forging.

TABLE 9

| Sample No. | Properties of forged magnesium alloys composite processed by mechanical alloying: Matrix Alloy Composition Nominal (at %) | SiC (Vol. %) | Density (kg/m$^3$) | Hardness (RB) | CTE (20–450° C.) $\times10^{-6}$/°C. |
|---|---|---|---|---|---|
| 37 | $Mg_{92}Al_5Zn_2Nd_1$ | 30 | 2.36 | 102 | 12.8 |
| | Sample Outside of Invention | | | | |
| 38 | $Mg_{92}Al_5Zn_2Nd_1$ | 0 | 1.93 | 76 | 28.2 |

Forgings were machined by electrodischarge machining (EDM) to specimens of 0.16" in diameter and 1" in length, with longitudinal direction transverse to the forging direction, for compression testing. Compressive properties of the forged composites were evaluated according to ASTM standard E9-81 [Standard Methods for Compression Testing of Metallic Materials at Room Temperature].

Compressive properties were measured in uniaxial compression transverse to the forging direction, at a strain rate of about 8-$10^{-4}$/sec at room temperature. The compressive properties measured at room temperature are summarized in Table 10. The forging of MMC's shows very attractive properties. For example: $Mg_{92}Al_5Zn_2Nd_1$ + 30 v/o SiC has a density of 2.36 kg/m$^3$ (0.085 lb/in$^3$), Rockwell B hardness of 102, coefficient of thermal expansion of $12.8\times10^{-6}$/° C. ($7.1\times10^{-6}$/° F.), ultimate compressive strength of 690 MPa (100 ksi), compressive strain of 0.4%, and elastic modulus of 85 GPa (12.3 Msi).

EXAMPLE 6

$Mg_{92}Al_5Zn_2Nd_1$ + 10 v/o SiC extrusion and $Mg_{92}Al_5Zn_2Nd_1$ + 30 v/o SiC forging were machined by electro discharge machining (EDM) to specimens of 0.16" in diameter and 1" in length, with longitudinal direction transverse to the forging direction. Samples were annealed at temperatures ranging from 350° C. to 500° C. for 1800 seconds and quenched in water.

Samples were attached with strain gauge for compressive testing. Compressive properties of the composites were evaluated according to ASTM standard E9-81 [Standard Methods for Compression Testing of Metallic Materials at Room Temperature]. Compressive properties were measured in uniaxial compression along longitudinal direction, at a strain rate of about $8\times10^{-4}$/sec at room temperature. The compressive properties measured at room temperature are summarized in Table 11. The compositions produced by mechanical alloying as disclosed in the present invention are thermally stable at temperatures up to 500° C.

TABLE 10

| Sample No. | Compressive properties of forged magnesium alloy composite processed by mechanical alloying: Matrix Alloy Composition Nominal (at %) | SiC (Vol. %) | 0.2% CYS MPa | CUS MPa | El. (%) | E GPa |
|---|---|---|---|---|---|---|
| 39 | $Mg_{92}Al_5Zn_2Nd_1$ | 30 | 630 | 696 | 0.4 | 85 |
| | Sample Outside of Invention | | | | | |
| 40 | $Mg_{92}Al_5Zn_2Nd_1$ | 0 | 418 | 441 | 5.9 | 47 |

TABLE 11

| Sample No. | Compressive properties of extruded and forged magnesium alloy composite processed by mechanical alloying: Matrix Alloy Composition Nominal (at %) | SiC (Vol %) | Annealing Temp. (°C.) | CUS MPa | E GPa |
|---|---|---|---|---|---|
| 41 | $Mg_{92}Al_5Zn_2Nd_1$ | 10 | 350 | 613 | 73 |
| 42 | $Mg_{92}Al_5Zn_2Nd_1$ | 10 | 400 | 567 | 71 |
| 43 | $Mg_{92}Al_5Zn_2Nd_1$ | 30 | 400 | 756 | 92 |
| 44 | $Mg_{92}Al_5Zn_2Nd_1$ | 30 | 450 | 629 | 78 |
| 45 | $Mg_{92}Al_5Zn_2Nd_1$ | 30 | 500 | 725 | 86 |

The magnesium base metal matrix composite is especially suited for use in applications involving space and missile guidance, navigation, and control system precision components, where low density, very high specific stiffness and long term dimensional and environmental stability are the major performance criteria. Representative of such applications are an advanced composite optical system gimbal, guidance and control components, mirrors and precision components, gyro parts, instrumental covers, gyroscopes, accelerometers, and startracker mounting platforms.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. A method for making a magnesium based metal matrix alloy composite article, said method comprising the steps of:

(a) mixing and blending a magnesium based matrix alloy powder and a SiC particulate to achieve substantially uniform distribution of said particulate in said matrix alloy;

(b) forming said mixture into a consolidated body by the application of heat and pressure in vacuum;

(c) preheating and fabricating said consolidated body into an article by the application of heat and pressure.

2. A method of mixing and blending as recited in claim 7, wherein said powder and particulate are mixed by liquid suspension coprocessing, the suspending medium comprising distilled water having a pH ranging from about 8.5 to 11.5 and the agitation being effected by ultrasonification.

3. A method of mixing and blending as recited in claim 1, wherein said powder and particulate are mixed by ball milling a charge thereof, in a vacuum or protective environment, said charge having a weight ratio of powder to particulate ranging from 1:1 to 6:1.

4. A method as recited in claim 1, wherein said mixture is formed into a consolidated body at a consolidation temperature ranging from 250° C. to 500° C.

5. A method as recited in claim 1, wherein step (c) is carried out at a temperature ranging from 250° C. to 500° C.

6. A method as recited in claim 5, wherein said consolidated body is fabricated by extrusion at an extrusion ratio ranging from 8:1 to 22:1.

7. A method as recited in claim 5, wherein said consolidated body is fabricated by forging in a multi-step closed-die forging press adjusted to achieve 20% reduction in height for each step.

* * * * *